United States Patent [19]

Torigai

[11] Patent Number: 4,951,465

[45] Date of Patent: Aug. 28, 1990

[54] EXHAUST SYSTEM FOR MULTI-CYLINDER ENGINE

[75] Inventor: Katsumi Torigai, Hamamatsu, Japan

[73] Assignee: Sanshin Kogyo Kabushiki Kaisha, Hamamatsu, Japan

[21] Appl. No.: 463,785

[22] Filed: Jan. 8, 1990

Related U.S. Application Data

[63] Continuation of Ser. No. 214,220, Jul. 1, 1988, abandoned.

[51] Int. Cl.[5] ..... E01N 7/10

[52] U.S. Cl. ..... 60/323; 60/321; 440/89

[58] Field of Search ..... 60/321, 323; 440/89

[56] References Cited

U.S. PATENT DOCUMENTS

| | | | |
|---|---|---|---|
| 2,635,418 | 4/1953 | Leach | 60/323 |
| 3,772,887 | 11/1973 | Ziegler | 60/323 |
| 3,898,804 | 8/1975 | Morita | 60/323 |
| 3,969,893 | 7/1976 | Sakurai | 60/323 |
| 4,184,462 | 1/1980 | Hale | 60/323 |
| 4,458,491 | 7/1984 | Deutschmann | 60/323 |

*Primary Examiner*—Douglas Hart

*Attorney, Agent, or Firm*—Ernest A. Beutler

[57] ABSTRACT

A number of embodiments of exhaust arrangements for two cycle multiple cylinder internal combustion engine. In each embodiment, the cylinder block has exhaust ports that communicate with the cylinder bores and extend through a side surface of the cylinder block. This side is closed by a cover that forms a manifold for receiving the exhaust gases and lengthening the distance between the port and the junction with the manifold. In line and V-type embodiments are disclosed.

7 Claims, 4 Drawing Sheets

EXHAUST SYSTEM FOR MULTI-CYLINDER ENGINE

This is a continuation of U.S. patent application Ser. No. 214,220 filed July 1, 1988, and now abandoned.

BACKGROUND OF THE INVENTION

This invention relates to an exhaust system for a multi-cylinder engine and more particularly to an improved cylinder block, exhaust manifold arrangement for a multi-cylinder engine and particularly one of the V-type.

It is well known in conjuction with certain types of internal combustion engines, particularly the two cycle type as applied for the propulsion unit of a marine outboard drive such as an outboard motor, to form the exhaust manifold within the cylinder block where the exhaust ports and exhausts passages are cast. Although this arrangement has the advantage of simplicity and compactness, the performance of an engine may be changed significantly by changing the point where the exhaust ports merge into exhaust manifold. That is, the length of this distance to the juncture can, if appropriately selected, significantly improve the performance of an engine. However, where the manifold and exhaust ports are formed integrally within the cylinder block it is difficult to obtain the desired length changes. Furthermore, once an engine is built in this manner, it is impossible to change the length of the passages to suit specific applications.

It is, therefore, a principle object of this invention to provide an improved exhaust system for an engine.

It is a further object of this invention to provide an exhaust system for an engine including a manifold that is formed separately from the cylinder block so as to permit length changes for tuning purposes.

It is a still further object to this invention to provide an improved cylinder block manifold arrangement for a two cycle internal combustion engine of the type employed in an outboard motor.

SUMMARY OF THE INVENTION

This invention is adapted to be embodied in an exhaust arrangement for an internal combustion engine having a cylinder block defining a cylinder bore and an exhaust port that extends from the cylinder bore through the cylinder block and which terminates in an exhaust opening formed in an external face of the cylinder block. An exhaust cover is affixed to the cylinder block and covers the exhaust opening. An exhaust manifold is formed by the exhaust cover and defines an exhaust passage extending from the exhaust opening through the exhaust cover for conveying exhaust gases from the exhaust port to the atmosphere.

DETAILED DESCRIPTION OF THE PREFERRED EMBODIMENT

Figure 1:
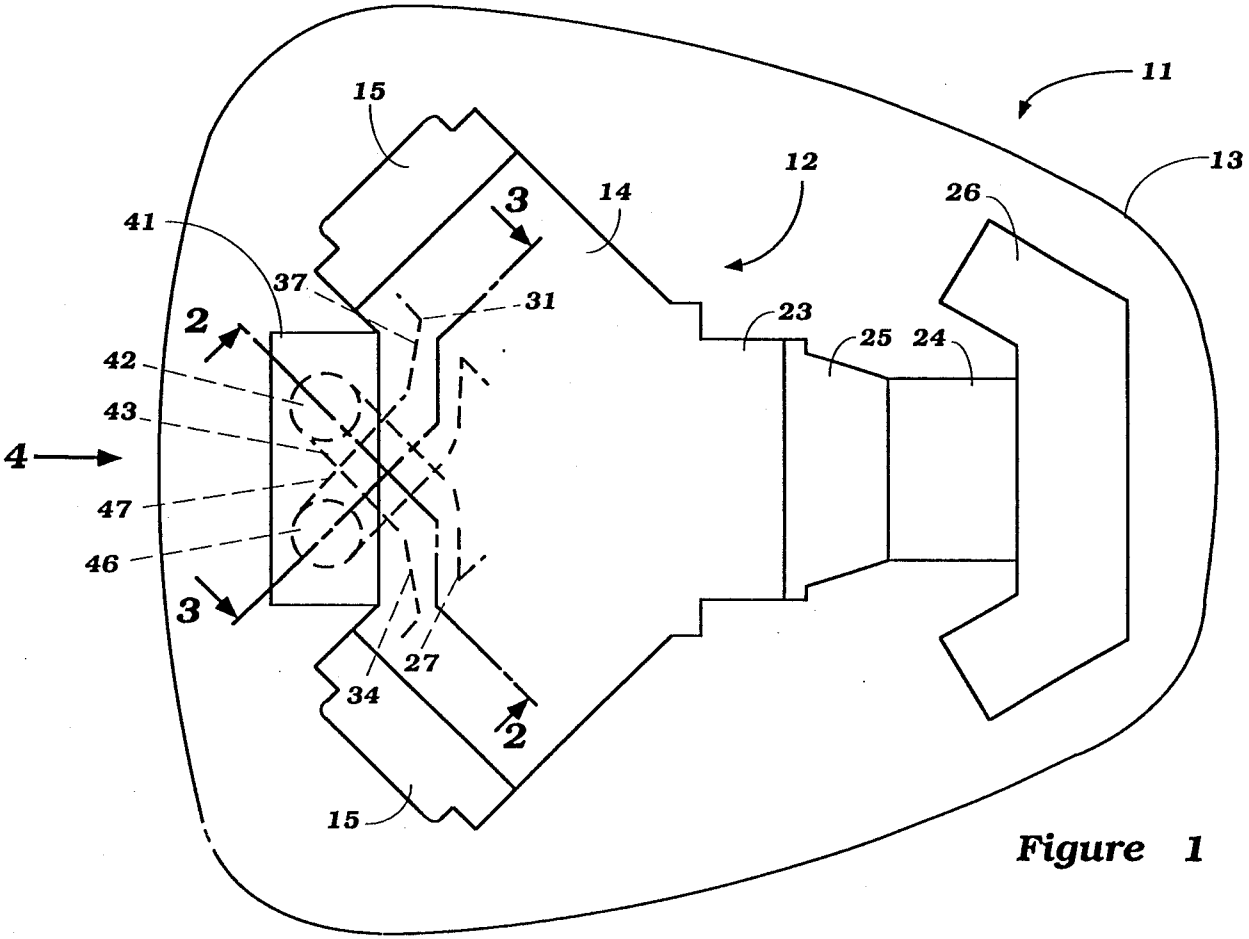
FIG. 1 is a top planned view of an outboard motor constructed in accordance with an embodiment of the invention.
Figure 4:
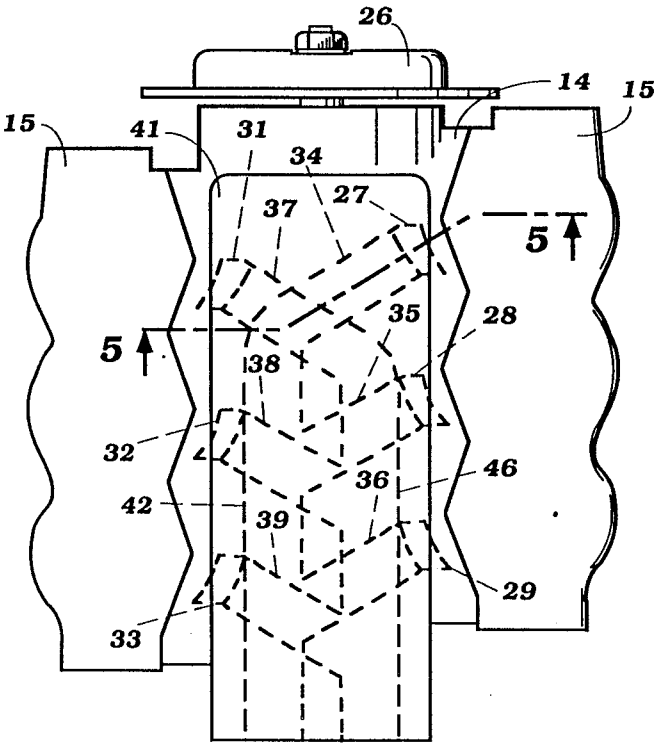
FIG. 4 is a view looking generally in the direction of the arrow 4 in FIG. 1.
Figure 3:
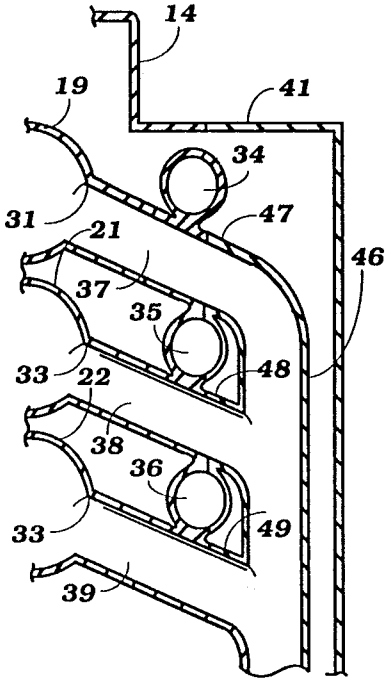
FIG. 3 is an enlarged cross sectional view taken along the line 3—3 of FIG. 1.
Figure 2:
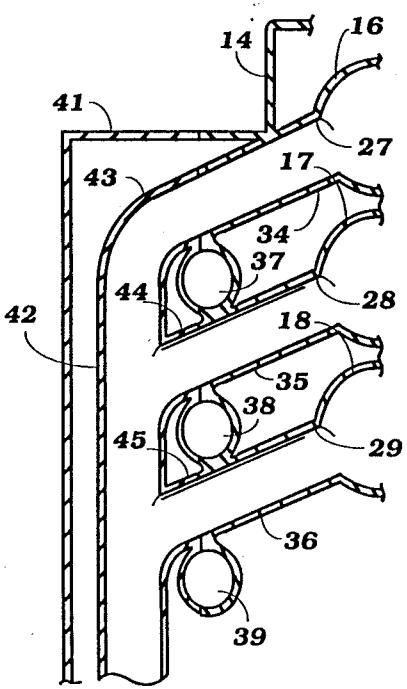
FIG. 2 is an enlarged cross sectional view taken along the line 2—2 of FIG. 1.
Figure 5:
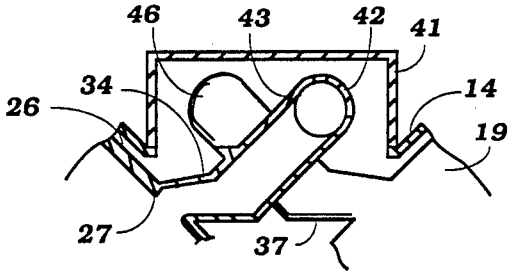
FIG. 5 is a cross sectional view taken generally along the line 5—5 of FIG. 4.

Referring first to the embodiment of FIGS. 1 through 5, an outboard motor constructed in accordance with this embodiment is illustrated partiallly and is identified generally by the reference numeral 11. The invention deals with the construction of the exhaust system for an internal combustion engine, indicated generally by the reference numeral 12 for the outboard motor 11. Although the invention is adapted to be utilized in other embodiments than outboard motors, the construction of the manifold arrangement which forms the invention, is particularly adapted for use in outboard motors because of the compact configuration and the orientation of the engine 12, as will be described. The engine 12 is surrounded by a protective cowling 13 of the outboard motor 11, as is well known in such applications.

In this embodiment, the engine 12 is of the two cycle crankcase compression type. The engine 12 includes cylinder block 14 which has a pair of angularly disposed cylinder banks with a respective cylinder head 15 being affixed to each cylinder bank. In this embodiment, the engine is of the V-six type and, there are three individual cylinders formed in each bank of the cylinder block 14. The cylinders appear in FIGS. 2 through 4 and are identified by the reference numerals 16, 17 and 18 in connection with one cylinder bank and 19, 21 and 22 in connection with the other cylinder bank. Basically the construction of the internal components of the engine 12 may be considered to be conventional, except for the exhaust system, to be described. For that reason these conventional components have not been illustrated and will not be described.

The engine 12 is provided with a crankcase 23 that is divided into a plurality of sealed chambers, in known manner, each of which cooperates with a respective one of the cylinder bores 16, 17, 18, 19, 21 and 22. A charge forming device in the form of a carburetor or plurality of carburetors 24 delivers a charge to the sealed chambers through an intake manifold 25. Reed type valve assemblies are provided in the mfanifold 25 so as to prevent reverse flow from the crankcase chamber into the carburetors 24. An air silencer 26 is attached to the carburetors 24 for drawing air from within the protective cowling 13 and delivering it to the carburetor 24 in known manner.

The charge which is admitted to the chambers of the crankcase 23 is compressed upon downward movement of the pistons and then transferred to the area above the pistons and below the cylinder heads 15 for combustion in a known manner.

Because of the utilization of the engine 12 as a power plant for an outboard motor, the axis about which the crankshaft of the engine rotates extends generally vertically and flywheel magneto 26 is attached to the upper end of the crankshaft. This flywheel magneto cooperates with a suitable ignition system for firing the charge in the combustion chamber.

The charge which has been fired in the combustion chamber is discharged through respective exhaust ports 27, 28, 29, 31, 32 and 33 formed in the cylinders 16, 17, 18, 19, 21 and 22 respectively. The exhaust ports 27, 28, 29, 31, 32 and 33 each cooperate with respective exhaust passages 34, 35, 36, 37, 38 and 39 formed in the cylinder block 14. It should be noted that the exhaust passages 34, 35 and 36 extend toward the opposite bank as do the exhaust passages 37, 38 and 39. In addition, these passages extend in a generally downward direction and they terminate in openings formed in an outer face of the cylinder block 14. In a conventional construction, these passages would then extend into a manifold section that is formed integrally in the cylinder block.

In accordance with the invention, however, there is provided a manifold cover 41 that is attached in a suitable manner to the cylinder block 14 and which forms a closure for the exhaust passage openings. Also formed integrally within the exhaust cover 41 is a first manifold 42 that has runners 43, 44 and 45 which mate with the discharge ends of the exhaust passages 34, 35 and 36 and form extensions of them. As a result, the juncture of these extended passageways with the manifold 42 can be extended to a greater extent than heretofore possible in arrangements wherein the manifold was formed intergrally in the cylinder block. In a like manner, the cover forms a second manifold 46 that has runners 47, 48 and 49 that cmmunicate with the discharge ends of the exhaust passages 37, 38 and 39 to provide the same effect. In this embodiment, it should be noted that the manifold 46 is adjacent the cylinder block bank where the exhaust ports 27, 28 and 29 lie while the manifold 42 is adjacent the bank wherein the exhaust ports 31, 32 and 33 lie. This crossover arrangement permits the greater length which has already been mentioned and more effective tuning under some circumstances.

The exhaust manifolds 42 and 26 communicate with an exhaust system of a known type conained within the driveshaft housing and lower unit (not shown) of the outboard motor 11 for discharge of the exhaust gases to the atmoshphere.

Figure 6:
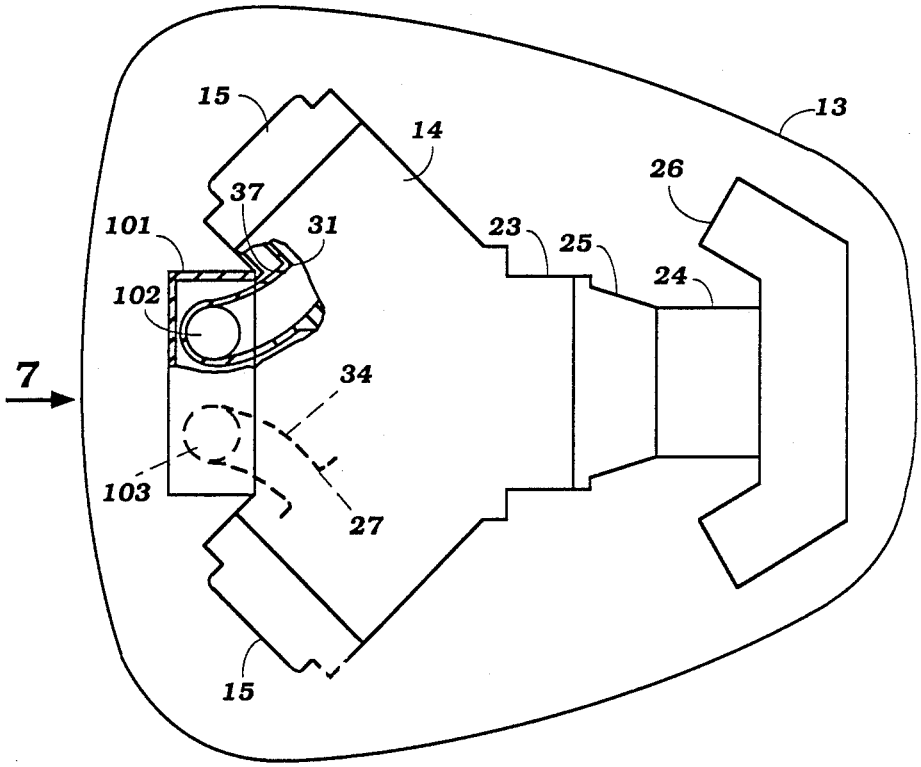
FIG. 6 is a top plan view, in part similar to FIG. 1, showing another embodiment of the invention.
Figure 7:
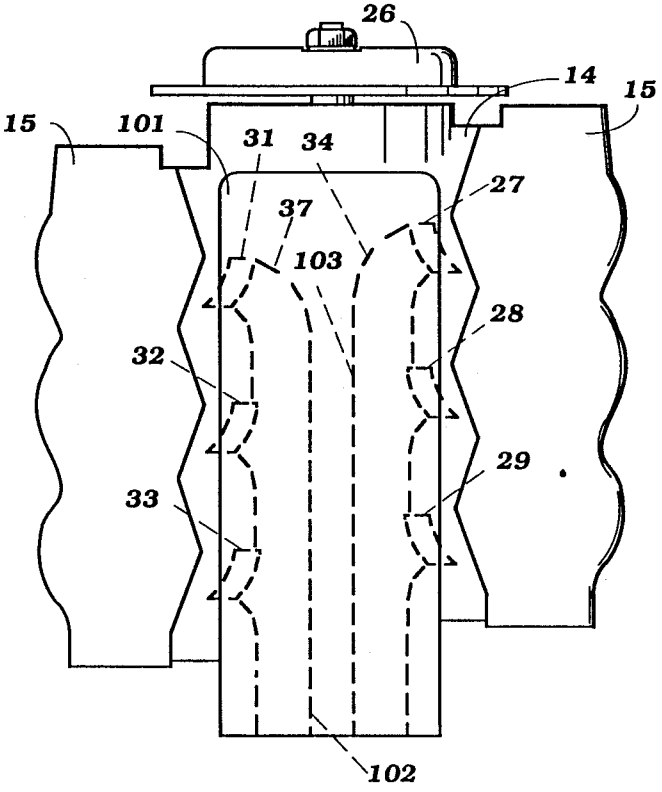
FIG. 7 is an end elevational view fo the embodiment of FIG. 6 taken generally in the direction of the arrow 7.

As had been noted, in the embodiment of FIGS. 1 through 5, the exhaust passages from the individual cylinder banks crossover each other and the exhaust manifold for a each cylinder bank lies adjacent the opposite cylinder bank. In some instances, it may not be desirable to provide such a great length extension and FIGS. 6 and 7 show another embodiment. In this embodiment, the major components of the engine are the same and they have been identified by the same reference numerals.

In this embodiment, the individual cylinder bores all communicate with exhaust ports and exhaust passages formed in the cylinder block 14 and these exhaust ports and exhaust passages have been identified by the same reference numerals. However, in this embodiment the individual cylinder exhaust passages do not cross over those from the opposite cylinder bank but terminate adjacent the same cylinder bank. These exhaust passages terminate in exhaust openings formed the side of the cylinder block.

These openings are closed by means of an exhaust cover 101. The exhaust cover 101 is formed with a first manifold 102 that has runners that cooperate with the exhaust passage openings of the cylinder bank in which the exhaust passages 31, 32 and 33 are formed. In a like manner, the cover 101 is formed with a second manifold 103 that cooperates with the exhaust passages 34, 35, and 36. As a result, in this embodiment the exhaust manifolds 103 and 102 are formed adjacent the cylinder banks in which their are cooperating exhaust ports are formed and a shorter overall length can be achieved. However, the length is greater than that that would be possible were the manifold sections 102 and 103 formed in the cylinder per se.

Figure 8:
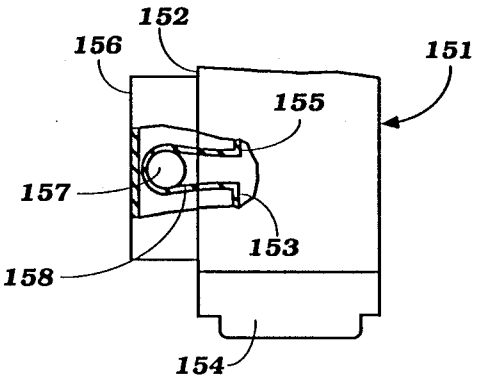
FIG. 8 is a top plan view, in part similar to FIGS. 1 and 6, showing a third embodiment of the invention.

In the two embodiments of the invention as thus far described the engine embodying the manifold and exhaust system was of the V-type. It is to be understood, however, that the invention may also be utilized in conjunction with in-line type engines and FIG. 8 shows such an embodiment. In this embodiment, an engine 151 is provided with a cylinder block 152 in which cylinder bores 153 are formed. A cylinder head 154 is affixed to the cylinder block 152 and forms a closure for the cylinder bores 153. It should be understood that any number of aligned cylinders may be employed in conjunction with this invention.

Each cylinder 153 has exhaust port 155 that extends through a side of the cylinder block 152 and which forms a discharge opening in this side. The discharge opening is covered by means of an exhaust cover 156 that is fixed to the cylinder block 151 and which defines a manifold 157 having runners 158 that cooperated with these openings to form an extension for the exhaust passage from the exhaust ports 155 to the respective junction with the manifold 157.

It should be apparent that a number of embodiments of the invention have been illustrated and described each of which permit the use of an elongated exhaust passage for an internal combustion engine so as to lengthen the point where the exhaust ports merge with the exhaust manifold and permit the appropriate tuning. Although a number of embodiments of the invention have been illustrated and described, various changes and modifications may be made without departing from the spirit and scope of the invention as defined by the appended claims.

I claim:

1. An exhaust arrangement for an internal combustion engine having a cylinder block defining at least two cylinder bores, an exhaust port extending from each cylinder bore through said cylinder block and terminating in a respective exhaust opening formed in an external face thereof, an internal exhaust cover affixed to said cylinder block and covering said exhaust opening, and an exhaust manifold formed integrally by said exhaust cover and defining with said exhaust openings individual runners and a common collector section into which said runners discharge to form a complete exhaust passage extending from said exhaust openings through said exhaust cover and a discharge from said collector section for conveying exhaust gases from said exhaust ports to the atmosphere.

2. An exhaust arrangement as set forth in claim 1 wherein the cylinder block defines a plurality of cylinder bores each having an exhaust port and the manifold forms a common exhaust passage for the exhaust ports.

3. An exhaust arrangement as set forth in claim 2 wherein the cylinder block is formed in banks and there is a separate exhaust manifold formed for the exhaust ports of each bank.

4. An exhaust arrangement as set forth in claim 3 wherein the exhaust manifold for each bank lies adjacent the bank.

5. An exhaust arrangement as set forth in claim 4 in combination with an outboard motor wherein the engine has a crankshaft rotating about a vertically extending axis and the exhaust manifolds extend in a generally vertical direction.

6. An exhaust arrangement for an internal combustion engine having a cylinder block defining cylinder banks each having a cylinder bore, an exhaust port extending from cylinder bore through said cylinder block and terminating in a respective exhaust opening formed in a respective external face thereof, an exhaust cover affixed to said cylinder block and covering said exhaust openings, and a pair of exhaust manifolds formed integrally by said exhaust cover and defining a complete exhaust passage extending from said exhaust opening through said exhaust cover and a discharge for conveying exhaust gases from said exhaust port to ther atmosphere, said exhaust manifold for each bank lying adjacent the opposite bank.

7. An exhaust arrangement as set forth in claim 6 in combination with an outboard motor wherein the engine has a crankshaft rotating about a vertically extending axis and the exhaust manifolds extend in a generally vertical direction.

* * * * *